US005417383A

United States Patent [19]

Rodriguez et al.

[11] Patent Number: 5,417,383

[45] Date of Patent: May 23, 1995

[54] TREATING AND DISPENSING SYSTEM FOR CUTTING TAPE

[75] Inventors: Peter A. Rodriguez, Atlantic Beach; Craig R. Austin, Jacksonville; Jason C. Rodriguez, Atlantic Beach, all of Fla.

[73] Assignee: Sandar Industries, Inc., Atlantic Beach, Fla.

[21] Appl. No.: 152,748

[22] Filed: Nov. 15, 1993

[51] Int. Cl.[6] ..... B65H 19/28

[52] U.S. Cl. ..... 242/526.2

[58] Field of Search ..... 242/56 R, 65, 74, 526.2

[56] References Cited

U.S. PATENT DOCUMENTS 2,461,246 2/1949 Weyenberg ..... 242/56 R 4,659,029 4/1987 Rodriguez ..... 242/56 R 4,757,950 7/1988 Rodriguez ..... 242/56 R 4,783,018 11/1988 Rodriguez ..... 242/56 R 5,046,675 9/1991 Rodriguez ..... 242/56 R

*Primary Examiner*—Daniel P. Stodola

*Assistant Examiner*—John P. Darling

*Attorney, Agent, or Firm*—Arthur G. Yeager

[57] ABSTRACT

A system for feeding a cutting tape for a paper wind up machine along a track guide to apply a strip of adhesive to the forward end, measure it and cut the tape to a desired length, store it temporarily in the form of a hanging loop, feed the adhesive coated forward end to the exit end of the track adjacent a new roll for wind up of a paper web, and a brake to provide resistance to the tape so as to become tension to cut the web of paper and transfer it to the new roll.

20 Claims, 2 Drawing Sheets

TREATING AND DISPENSING SYSTEM FOR CUTTING TAPE

BACKGROUND OF THE INVENTION

U.S. Pat. Nos. 4,659,029; 4,757,950, 4,783,018; and 5,046,675 illustrate the most pertinent art relating to this invention.

These patents show how a cutting tape can be passed through a guideway underneath a travelling web of paper, perhaps 10 to 20 feet or more wide and be attached to the far side of an empty spool while the operator remains on the near side Of the spool. These patents teach the use of mechanical arms to receive a cut end of the tape with adhesive on the tape, and to push the cut end into contact with the empty spool which winds the tape helically around the spool, cutting the paper web as it does, and wrapping the oncoming web around the empty spool. Processing difficulties have arisen to indicate the need for improved procedures for handling and treating the tape so as to perform the cutting operation more efficiently.

It is an object of this invention to provide an improved system for treating a tape to make it suitable for use as a cutting tape, and for handling it so as to perform the cutting of the paper web efficiently. It is another object of this invention to provide an improved system for storing the tape temporarily before it is used to cut the paper web. Still other objects will appear from the more detailed description which follows.

BRIEF SUMMARY OF THE INVENTION

This invention relates to a system for preparing a selected length of cutting tape to be used to cut a travelling web of paper being wound on a first roll and transferring the cut edge to a second roll to continue the wind up, the system comprising feeding an endless length of cutting tape into a track for guiding the tape; a friction drive first feed wheel in contact with the tape and causing the tape to move along the track; a means for applying a selected length of pressure-sensitive adhesive to a surface of the tape; a means for directing a rearward portion of the selected length into a temporary storage loop; a cutter for cutting the adhesive coated tape to a selected length; a friction drive second feed wheel for moving the cut length of adhesive coated tape along the track; an encoding wheel in contact with the tape for measuring the length of tape for cutting; a bypass means to direct tape with no adhesive coating away from the track; and a brake means to apply resistance to the passage of tape at a selected time.

In specific and preferred embodiments of the invention the tape, after having its forward end coated with an adhesive layer, is directed into a downwardly hanging loop for temporary storage before it is used to cut a moving web of paper. This step is accomplished by actuating a downwardly moving plunger which strips the tape from a short section of the track while leaving the tape ahead of and behind that section still in the track. The tape behind the section continues to move ahead and is diverted from the track so as to form a hanging loop of tape.

Other specific embodiments involve the adhesive coating operation which includes rollers, channel guides, and a brake lever all enclosed in a cassette-like cartridge to protect the adhesive from dust. The cartridge is replaceable when necessary.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features and improvements of this invention are best understood by reference to the attached drawings. In my previous patents U.S. Pat. No. 4,659,029; 4,783,018; and 5,046,675 it can be seen that there are three sections of the track guide that directs a cutting tape from the proximal side of the web of paper and the wind up rolls to the distal side thereof. The operator is generally positioned at the proximal side so as to operate and control the preparation and feeding of the cutting tape to the distal side where it is introduced to the nip between a driving roll and an empty wind up roll. The three sections of track may be referred to as the dispensing section, the cross machine section, and the curved section. The dispenser section is that which is the subject of the present invention and which includes the controls and treatment devices on the proximal side of the web of paper. The cross machine section is essentially a straight section of track to guide the tape from the proximal side to the distal side underneath the travelling web of paper. The curved track section connects the distal end of the cross machine track to the end of the track positioned close to the nip between the driving roll and the empty wind up roll so as to permit the forward end of the tape to be extended outwardly from the end of the track and be caught in the nip. Once the tape is caught in the nip it will stick to the empty wind up roll, and be wrapped around that roll in a helical path. The proximal end of the tape is restrained by a brake which causes the tape to be pulled taut, cutting the web of paper where the tape and the web intersect, and leading the cut edge to the empty wind up roll which then continues to wind up the web until it is time to repeat the cutting and transfer to still another wind up roll.

Figure 1:
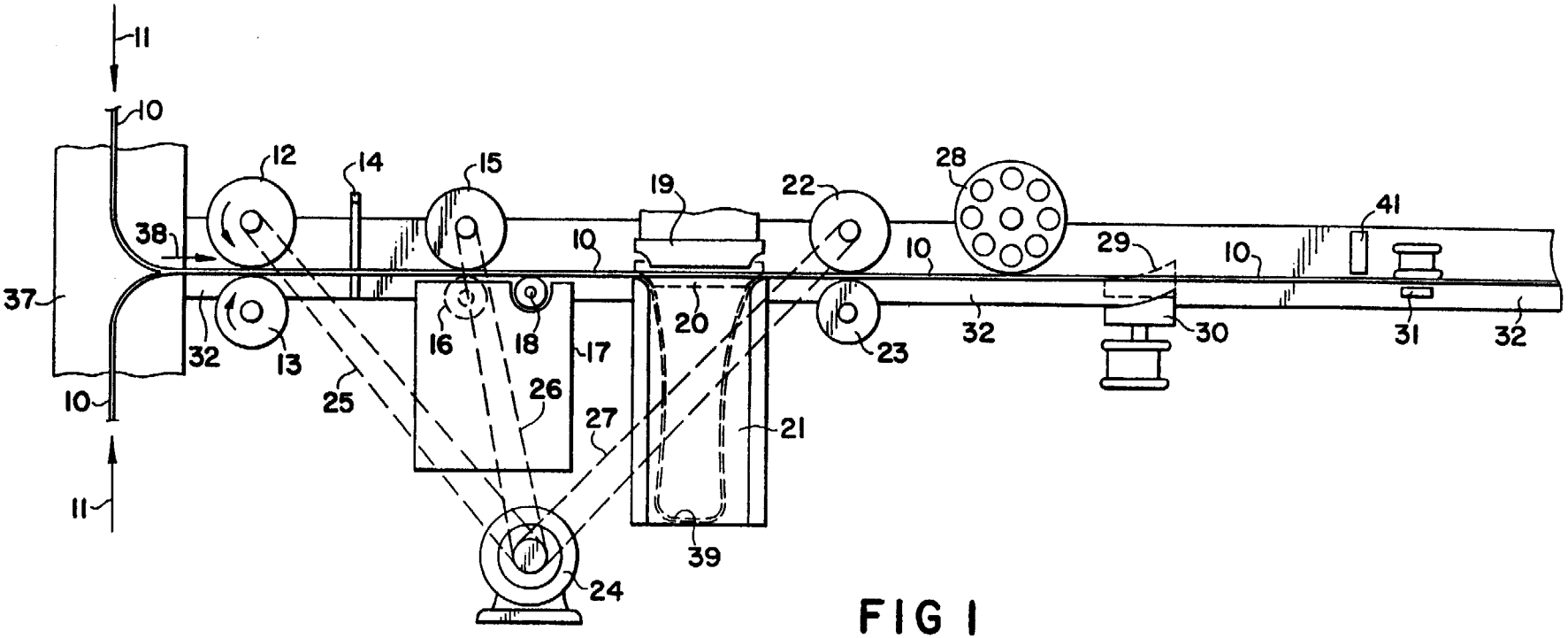
FIG. 1 is a schematic front elevational view of the dispenser portion of the track which receives the cutter tape, treats it, and stores it for introduction into the downstream portion of the track which leads the tape close to the nip of the empty wind up roll to which the web of paper is to be introduced.

The dispensing section of the track, along with its associated controls and treating devices is illustrated in FIG. 1. Cutting tape 10 is introduced into track 32 through feed guide 37. For use in cutting a web of paper it is preferred that tape 10 be that described in my U.S. Pat. No. 4,659,029 as a plurality of (about 10–20) parallel strands of repulpable paper fiber adhered to each other in a flat layer about 0.5–1.0 inch wide and 0.02–0.05 inch thick. Other types of tapes are completely operable in this system and are intended to be included in this system.

Tape 10 can be introduced into feed guide 37 from a roll or any other storage device. It is a preferred means to employ rolls of tape in an enclosed package so as to maintain as much cleanliness and dust-free condition as possible. Such packages can be cartridges or cassettes that can be replaced and the tape ends spliced together or fed into the system after the previous roll of tape is completely consumed, as needed. Tape 10 enters track 32 which normally is a horizontally positioned covered track through which the tape can travel in a horizontal position in the direction of arrow 38, i.e. from left to right in FIG. 1. The remaining description of wheels, rollers, etc. are in the order shown in FIG. 1 from left to right. That order may be modified in actual practice so as to save space or be more convenient. In only a few instances, which will be noted, is sequence or a particular order of placement of any importance.

Main drive wheel or first drive wheel 12 is pressed against the upper surface of tape 10 while drive press wheel 13 provides the counteracting force against tape. The turning of wheels 12 and 13 in the direction of the arrows as shown moves tape 10 along track 32 from left to right.

Cutter 14 cuts tape 10 at a specified time so as to have a specific length of tape 10 ahead of (to the right of in FIG. 1) cutter 14. That length is whatever is necessary to have the forward end of tape 10 at the distal end of track 32 while the rearward end of tape 10 is sufficiently behind (to the left of) brake 31 so as to keep tape 10 taut as it cuts the web of paper. Cutter 14 can be any type of cutter although it is preferred for it to be a guillotine cutter wherein a moving knife blade cuts completely across tape 10 in one quick movement. Cutter 14 is controlled through encoder wheel 28 which actually measures the length of tape 10 passing by. At a selected length cutter 14 is activated.

Next in line is the adhesive coating component involving adhesive applicator roll 16 pressing against the bottom of tape 10 while press roll 15 provides the counteracting force against the upper surface of tape 10. This component is described and claimed in my copending patent application Ser. No. 08/152,749, filed Nov. 15, 1993 entitled Adhesive Dispenser and filed concurrently herewith. This component includes a roll of double-sided pressure-sensitive tape adhered to a backing layer; a channel leading to adhesive applicator roll 16, a channel to guide the stripped backing layer away for disposal and a spring-biased brake lever adapted to prevent adhesive applicator roll from rotating until the brake lever is released. All of these components are housed in a cassette-type container 17 to keep the adhesive layer free from dust and other contamination until pressed against the lower surface of tape 10. As a cassette or cartridge 17, the entire mechanism and supply of composite tape can be replaced readily without any necessity to rethread the composite tape.

Adhesive detector wheel 18 follows closely upon adhesive applicator roller 16. Wheel 18 has a surface pressed lightly against the lower surface of tape 10, and that surface is sensitive to the adhesive applied to tape 10 by roller 16. If there is adhesive on tape 10, wheel 18 will be contacted thereby and will rotate as the layer of adhesive passes by. If for any reason the adhesive layer is not present, wheel 18 will not turn. A sensor, not shown detects the rotation of wheel 18 and signals to the relevant components, e.g., tape bypass 30 that all is okay for the tape to proceed to the distal side to do its job of winding onto an empty wind-up roll. If the sensor does not detect any rotation of wheel 18, the procedure must be aborted until an adhesive coated forward end of tape 10 can be assured. This can be done by manually applying adhesive to the forward end of tape 10, or the tape can be removed and thrown away, while a new length of tape is processed from the beginning. Generally, the sensor controls the operation of tape bypass 30, which will be discussed below.

Tape 10 with its forward end coated with adhesive on its lower surface for a short length of about 6–12 inches proceeds through track 32 above loop storage container 21. Longer lengths of adhesive are operable but generally are wasteful of adhesive. When the forward end of tape 10 reaches the distal end of track 32 adjacent the empty wind up roll brake 31 is applied, and plunger 19 is activated and moves from its up position 19 (solid lines) to its down position 20 (dotted lines). This forces the rearward portion of tape 10 which is contacted by plunger 19, 20 out of the confines of track 32. Main drive wheel 12 continues, to run and thereby feed more of tape 10 forward to be diverted downwardly into a hanging loop 39. The bottom of container 21 is closed and the tape entering container 21 forms into one or more loops for temporary storage there. The face of plunger 20 is contoured to function as a lead-in and a lead-out of track 32; and, therefore, tape 10 is held in track 32 just ahead of and just beyond plunger 20. When first drive wheel 12 has pushed a preselected length of tape 10 forward, it stops and cutter 14 is activated to cut tape 10. This produces a finite selected length of tape 10, some of which is stored in loop 39.

Second drive wheel 22 cooperates with second drive press wheel 23 to drive the cut length of tape 10 ahead when it is ready to cut the web of paper and transfer the cut edge to a new empty wind up roll. Second drive wheel 22 and second drive press wheel 23 are essentially the same in operation and design as wheels 12 and 13. Wheels 12, 15, and 22 must be driven by some coordinated source. Generally it is preferred to drive each by a single motor 24 with some form of belt drives 25, 26, and 27, respectively. In some circumstances, wheel 15 may be passive and not driven when the adhesive being applied to the cutting tape 10 does not require rigorous application techniques.

Encoder wheel 28 is a distance or length measuring device in contact with tape 10 so as to measure directly how much length of tape 10 has passed by. This is important to control when to use cutter 14 and also when to stop the forward movement of adhesive-coated forward end of tape 10 when it reaches the distal end of track 32.

Tape bypass device 30 is a simple switching mechanism which is movable from its noninterfering position 30 (in solid lines) to its bypass position 29 (in dotted lines). This device is employed when adhesive detector wheel 18 fails to detect any adhesive coating on tape 10. Bypass device 30 is activated to move its switch surface to position 29 which strips tape 10 from track 32.

Brake 31 may not be directly a part of the dispenser section in a strict sense, but it can best be considered so for the purposes of this invention. Brake 31 is capable of clamping tape 10 so that it cannot move, but normally the clamping pressure is to provide a resistance to the passage of tape 10 during cutting of the travelling web of paper (not shown). Brake 31 can be merely a pair of opposing pads which clamp against opposite surfaces of tape 10. Brake 31 is clamped after the forward end of tape 10 is advanced to the distal end of track 32, and not released until the operator is ready to project the forward end of tape 10 into the nip and thereby begin the web cutting and web transfer operations. When the forward end of tape 10 is caught in that nip, it begins to wrap itself around the wind up roll, and tape 10 must be held taut in order to perform its operations of cutting and transferring. For this purpose brake 31 is clamped so as to provide sufficient frictional resistance to the otherwise rapid removal of tape 10 from track 32. This is a somewhat vigorous action by tape 10 since it actually is ripped out of the top of track 32, rather than rapidly moving through track 32 to its end.

Cutter tape sensor 41 is located closely upstream of brake 31. Sensor 41 is needed to sense the presence of tape 10 in the track 32 immediately short of brake 31. It is possible that tape 10 might break due to the tensile forces produced when brake 31 tightens onto tape 10 when it is cutting the web of paper and being wound onto the wind up roll. If tape 10 breaks it will do so downstream of brake 31 leaving some unused tape 10 in track 32 upstream of break 31. In order for the operator to prepare a new length of cutting tape and position it for the next cutting and winding operation track 32 must be unobstructed. Hence sensor 41 tells the operator that unused tape 10 is still in track 32 and must be removed before the next cutting and winding operation.

Figure 3:
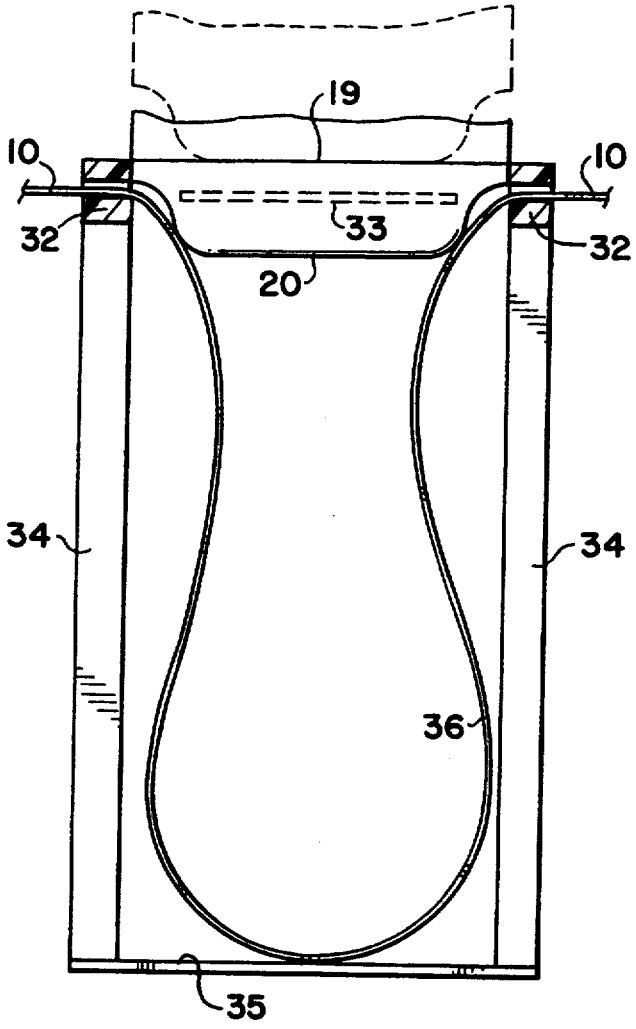
FIG. 3 is a cross-section taken at 3—3 of FIG. 2.
Figure 2:
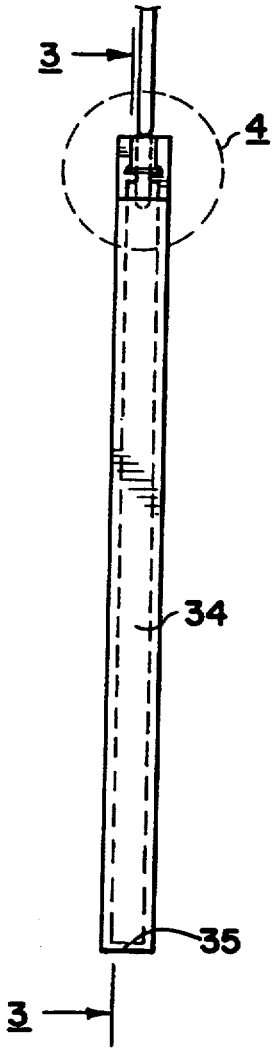
FIG. 2 is a side elevational view of the loop storage device of this invention.
Figure 4:
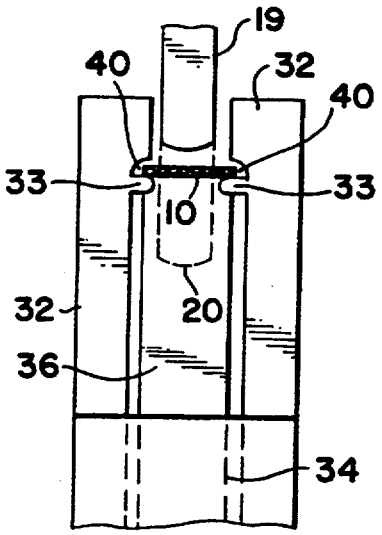
FIG. 4 is an enlarged side elevational view of the portion of FIG. 2 marked "4".

FIGS. 2–4 show the details of loop container 21, which is merely a four sided container. At the top end plunger 19, 20 can move up and down to clear track 32 or to interrupt it. It may be seen in FIG. 4 that plunger 19,20 is thin enough to move up and down between lips 33 which support tape 10 in a thin, flat rectangular tunnel 40. When plunger 19 moves to position 20 it causes tape 10 to bend downwardly with its two edges resting on lips 33, until it bends sufficiently to slip past lips 33. Tape 10 then is removed from track 32 and will fall freely into loop 36 as shown in FIG. 3.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A system for preparing a selected length of cutting tape to be used to cut a travelling web of paper being wound on a first roll and transfer the cut edge to a second roll to continue the wind up, the system comprising feeding an endless length of cutting tape into a track for supporting and guiding the tape; a friction drive first feed wheel in contact with the tape and causing the tape to move along the track; a means for applying a selected length of pressure-sensitive adhesive to a surface of the tape; a vertically movable means for contacting the tape and directing a rearward portion of said selected length of tape into a temporary storage loop vertically disposed offset from said track; a cutter for cutting the adhesive coated tape to a selected length; a friction drive second feed wheel for moving the cut length of adhesive coated tape along said track; an encoding wheel in contact with said tape for measuring the length of tape for cutting; a by-pass means to direct tape with no adhesive coating away from said track; and a brake means to apply resistance to the passage of tape at a selected time.

2. The system of claim 1 wherein said movable means for directing tape into a temporary storage loop includes a plunger adapted to be moved vertically to push a short portion of said tape through a passageway transverse to said track and to guide tape moving toward said passageway into said passageway for temporary storage, said track adjacent each end of said short portion of said tape being free of any support for said tape.

3. The system of claim 1 wherein said means for applying adhesive is enclosed in a cartridge and includes applying a strip of double-sided pressure-sensitive adhesive to the lower surface of said tape as it moves horizontally in said track.

4. The system of claim 1 wherein said track is a horizontally positioned tunnel of polyolefin material having a longitudinal passage therethrough with a transverse cross-section that is rectangular and adapted to guide said endless tape therethrough.

5. The system of claim 1 which additionally includes a sensor wheel immediately following said means for applying adhesive, said sensor wheel being rotatable by contact with said pressure-sensitive adhesive on said tape and being nonrotatable by contact with said tape having no pressure-sensitive adhesive thereon.

6. The system of claim 1 having a motor means for driving said first roll and said second roll.

7. The system of claim 1 wherein said endless tape being fed thereinto is a roll of said tape enclosed in a dust-free cartridge.

8. The system of claim 1 wherein said cutter is a guillotine-type knife.

9. The system of claim 1 wherein said encoding wheel is a disc with its perimeter in contact with said endless tape and adapted to measure the length of said tape passing by and to signal said cutter when to cut said tape to a selected length.

10. The system of claim 1 wherein said length of pressure-sensitive adhesive is applied to the forward end of said tape and extending rearwardly for a distance of 6–12 inches.

11. A system for preparing a selected length of cutting tape to be directed through an enclosed track from a proximal end to a distal end across the width of a web of paper being wound onto a roll, the system comprising feeding an endless length of cutting tape from a supply source into a horizontal track so as to pass several stations for treatment and temporary storage; a first drive wheel contacting said tape in said track and pushing said tape along said track; a guillotine cutter for cutting said tape to a selected length; a combination of wheels and a brake enclosed in a cartridge and adapted to apply a strip of double-sided pressure-sensitive adhesive to the underneath surface of said tape as it passes by in said track; a vertically movable plunger means for diverting a substantial portion of said selected length of tape into a loop disengaged from said track for temporary storage, said upstream and downstream of said plunger means having no support for said tape permit formation of said loop; a second drive wheel positioned downstream of said loop and adapted to contact said tape and push it forward; an encoder wheel driven by contact with said tape and adapted to measure the length of tape passing by; a movable track switch adapted to divert the forward end of said tape out of said track if it does not have said strip of adhesive attached thereto; and a brake for applying frictional resistance to said tape moving forward in said track, said brake being located along said track adjacent said proximal end.

12. The system of claim 11 wherein said plunger means includes a short length of said horizontal track wherein said tape is supported by two spaced ledges that engage two opposite edges respectively of said tape with an open space between said two spaced ledges; and a movable reciprocable plunger adapted to move vertically in said open space from an upward position above said tape to a downward position below said ledges, and a vertically depending chute vertically below said plunger, said chute being enclosed by vertical side walls and a bottom wall so as to permit said tape to hang in said chute in a free loop with each upper end of said loop being engaged in said track.

13. The system of claim 11 which additionally includes a sensor located immediately after said cartridge and adapted to detect the presence of said adhesive strip on said tape.

14. The system of claim 11 wherein said track switch includes a curved cam surface movable from a position of not obstructing to a position of obstructing the movement of tape in said track and of diverting said tape out of said track.

15. A system for preparing a selected length of cutting tape to be used to cut a travelling web of paper being wound on a first roll and transfer the cut edge to an empty roll to continue the wind up, the system comprising feeding an endless length of cutting tape into a track for supporting and guiding the tape, a friction drive first feed wheel in contact with the tape for causing the tape to move along the track, means for applying adhesive to a lower surface of the tape, vertically movable means for directing a rearward end portion of said selected length of tape into a temporary storage loop, said movable means forcible moving said tape from said track to form a loop of tape at said rearward end portion, a cutter upstream of said storage loop for cutting the tape to said selected length, a friction drive second feed wheel for moving the cut length of tape along said track to push its forward end into contact with said empty roll, and a brake means to apply resistance to the passage of said tape at a predetermined time.

16. The system of claim 15 wherein said means for directing tape into a temporary storage loop includes a housing and a plunger adapted to be moved to push a short portion of said tape through a passageway transverse to and below said track and to guide said tape moving toward said passageway into said housing for temporary storage.

17. The system of claim 16 wherein said plunger remains in its position directing said tape through said passageway until after said tape is removed from said housing by cutting of the travelling web.

18. The system of claim 15 further comprising an encoding wheel movable by movement of said tape, said encoding wheel being a disc with its perimeter in contact with said tape and adapted to measure the length of said tape passing thereunder and to signal said cutter when to cut said tape to a selected length.

19. The system of claim 15 which additionally includes a sensor wheel immediately following said means for applying adhesive, said sensor wheel being rotatable by contact with said adhesive on said tape and being nonrotatable by contact with said tape having no adhesive thereon, by-pass means to direct tape with no adhesive away from said track.

20. The system of claim 19 wherein said encoding wheel signals said brake means to apply resistance to said tape and selectively to release same.

* * * * *